US008333164B2

(12) United States Patent
Herre et al.

(10) Patent No.: US 8,333,164 B2
(45) Date of Patent: Dec. 18, 2012

(54) COATING APPARATUS COMPRISING A METERING DEVICE

(75) Inventors: Frank Herre, Oberriexingen (DE); Rainer Melcher, Oberstenfeld (DE); Manfred Michelfelder, Hopfigheim (DE)

(73) Assignee: Duerr Systems, GmbH, Bietigheim-Bissingen (DE)

( * ) Notice: Subject to any disclaimer, the term of this patent is extended or adjusted under 35 U.S.C. 154(b) by 497 days.

(21) Appl. No.: 12/518,991

(22) PCT Filed: Nov. 7, 2007

(86) PCT No.: PCT/EP2007/009658

§ 371 (c)(1),
(2), (4) Date: Jun. 12, 2009

(87) PCT Pub. No.: WO2008/071273

PCT Pub. Date: Jun. 19, 2008

(65) Prior Publication Data

US 2010/0012025 A1 Jan. 21, 2010

(30) Foreign Application Priority Data

Dec. 12, 2006 (DE) ..... 10 2006 058 562
Jun. 25, 2007 (DE) ..... 10 2007 029 195

(51) Int. Cl.
*B05C 5/02* (2006.01)

(52) U.S. Cl. ..... 118/302; 118/629; 239/690; 239/708; 239/305; 222/325; 222/326; 222/333; 901/43

(58) Field of Classification Search ..... 118/300, 118/302, 323, 629; 239/690, 708, 305, 309, 239/327, 328; 222/325, 326, 333; 427/426, 427/427.2; 134/166 C; 901/43
See application file for complete search history.

(56) References Cited

U.S. PATENT DOCUMENTS 4,785,760 A * 11/1988 Tholome ..... 118/323
6,010,084 A 1/2000 Yoshida et al.
6,458,424 B1 * 10/2002 Yoshida et al. ..... 427/426
6,651,902 B2 * 11/2003 Ehinger et al. ..... 239/104
6,712,285 B2 * 3/2004 Provenaz et al. ..... 239/1

(Continued)

FOREIGN PATENT DOCUMENTS

CN 2629831 Y 8/2004

(Continued)

OTHER PUBLICATIONS

ISR and Written Opinion re PCT/EP2007/009658 dated Aug. 18, 2008.

*Primary Examiner* — Laura Edwards
(74) *Attorney, Agent, or Firm* — Bejin, VanOphem & Bieneman, PLC; Thomas E. Bejin; Charles A. Bieneman

(57) ABSTRACT

A coating apparatus for serially coating workpieces with different shades or colors is disclosed. A metering device comprises a plunger-type dosing mechanism or a metering pump that has a separate inlet with an integrated color valve for each of the most commonly used colors is located in or near the sprayer of the coating apparatus. A separate color changer can be provided for less frequently used colors. The outlet of said color changer may be connected to another inlet of the metering mechanism or to the discharge valve of the sprayer via a separate metering mechanism.

15 Claims, 9 Drawing Sheets

U.S. PATENT DOCUMENTS

| | | | | |
|---|---|---|---|---|
| 6,989,176 | B2 * | 1/2006 | Congard et al. | 427/427.2 |
| 2003/0041884 | A1 * | 3/2003 | Bahr | 134/22.12 |
| 2004/0081770 | A1 * | 4/2004 | Dattilo | 427/421 |
| 2005/0173018 | A1 * | 8/2005 | Herre et al. | 141/91 |

FOREIGN PATENT DOCUMENTS

| | | | |
|---|---|---|---|
| DE | 3005678 | | 8/1981 |
| DE | 4328088 | | 2/1995 |
| DE | 19500951 | | 8/1996 |
| DE | 69722155 | | 7/1997 |
| DE | 19836604 | | 3/2000 |
| DE | 19846073 | | 4/2000 |
| DE | 19951956 | | 6/2001 |
| DE | 10064065 | | 7/2001 |
| DE | 10136720 | | 2/2003 |
| DE | 10233404 | | 2/2004 |
| DE | 10309143 | | 9/2004 |
| DE | 10335358 | | 3/2005 |
| DE | 60103281 | | 5/2005 |
| DE | 102004058054 | | 6/2006 |
| DE | 102006022570 | | 11/2007 |
| DE | 102006045631 | A1 | 4/2008 |
| EP | 0338871 | | 10/1989 |
| EP | 0459892 | | 12/1991 |
| EP | 0693319 | | 1/1996 |
| EP | 0850693 | | 7/1998 |
| EP | 1000667 | | 5/2000 |
| EP | 1134027 | A2 | 9/2001 |
| EP | 1245291 | | 10/2002 |
| EP | 1245294 | | 10/2002 |
| EP | 1245295 | | 10/2002 |
| EP | 1287900 | | 3/2003 |
| EP | 1314483 | | 5/2003 |
| EP | 1346775 | | 9/2003 |
| EP | 1360996 | | 11/2003 |
| EP | 1376289 | | 1/2004 |
| EP | 1384885 | | 1/2004 |
| EP | 1502657 | | 2/2005 |
| EP | 1502658 | | 2/2005 |
| EP | 1502659 | | 2/2005 |
| EP | 1666158 | | 6/2006 |
| JP | 6246200 | | 9/1994 |
| JP | 7323245 | | 12/1995 |
| JP | 9308848 | | 12/1997 |
| WO | WO-9323173 | | 11/1993 |
| WO | WO-0151216 | | 7/2001 |
| WO | WO-0207899 | | 1/2002 |
| WO | WO-03095106 | A2 | 11/2003 |

* cited by examiner

COATING APPARATUS COMPRISING A METERING DEVICE

CROSS-REFERENCE TO RELATED APPLICATIONS

This application is a National Phase application claiming the benefit of International Application No. PCT/EP2007/009658, filed Nov. 7, 2007, which claims priority to German Patent Application Nos. DE 10 2006 058 562.3 and DE 10 2007 029 195.9, filed Dec. 12, 2006 and Jun. 25, 2007, respectively, and the complete disclosures of each are hereby incorporated by reference in their entireties.

FIELD

The present disclosure relates to a coating apparatus for serially coating workpieces with different colours as well as metering devices and containers usable for the same.

BACKGROUND

This includes, for example, serial coating of vehicle bodies and parts thereof with electrostatic or other atomisers including rotary atomisers, air atomisers etc., which apply the coating material using an automatically controlled metering device. Here, the term metering device generally includes volumetric metering devices, for example geared pumps or plunger-type metering mechanisms, which can be driven by a controllable motor such that the material quantity applied by the atomiser (instantaneous flow rate) can be adjusted during application as requested depending for example on the respective workpiece regions and other parameters, as elucidated for example in EP 1 314 483 A2 or DE 691 03 218 T2. The volumetric metering is typically performed by controlling the rotational speed of a geared pump or the piston speed of a plunger-type metering mechanism.

In many cases, gear metering pumps are advantageous for reason of compactness, continuous paint supply and cost benefits.

In contrast, plunger-type metering mechanisms have the benefit of higher metering precision by avoiding slippage between the gear pair and the socket housing of gear metering pumps, and in electrostatic painting devices, in which high-voltage insulation is required between the atomisers and their earthed supply system, the required electrical potential isolation can be attained by the intermittent paint delivering operation of a plunger-type metering mechanism. Further benefits will be explained.

As described in EP 1 772 194 A2, it may further make sense to connect a container serving as an interim paint storage repository of an electrostatic painting device upstream the plunger-type metering mechanism, which is already filled with the new colour in order to reduce the colour exchange time required during colour changes, while painting continues with the previous colour from the plunger-type metering mechanism. This storage vessel can also be defmied as a component of a metering device in terms of the exemplary illustrations. To drain the storage vessel, it can also include a plunger in the cylinder.

In place of volumetric metering, a paint pressure controller, e.g. in accordance with EP 1 287 900 A2, or in accordance with EP 1 34 6 775 A1, the main needle valve of the atomiser can serve as the final control element of a regulator circuit to control the paint quantity or flow rate and thus serve as a metering device.

EP 1 502 658 A1, DE 101 15 463 A1, DE 101 36 720 A1 and DE 695 10 130 T2 generally disclose metering devices incorporated into the atomiser.

For the case that an atomiser shall apply coating material with a large number of colours, which however may for example be limited by a paint circulation system, and a colour change shall be performed in the shortest possible time, colour-changer valve arrangements referred to as colour changers, are usually inserted in block assembly (i.e. as a mechanical unit), which connect the numerous colour inlets with the colour outlet leading to the atomising member via a central channel. Based on its usual modular assembly they can be adjusted to a differing number of selectable colours. Typical modular colour changers for wet paint, for example, are generally disclosed by DE 198 36 604 A1 and DE 198 46 073 A1, while a colour changer for powder paint similar in principle is described in DE 601 03 281 T2. For instance, DE 199 51 956 A1 relates to the flushing of colour changers. Such colour changers are typically connected upstream of gear or plunger metering devices or, where applicable, the mentioned paint storage vessel.

If only few colours are required, it is also possible to mount a colour changer into the atomiser, where applicable with a metering device downstream thereof (EP 1 502 658 A1), to shorten the distance to flush from the colour changer to the application member, such as the bell cup of a rotary atomiser, during a colour change. For this purpose, effort has been made to construct particularly compact colour changers (EP 1 502 659 B1), which is particularly important, if colour changers are required in a double assembly, which, as is well known, share paint supply lines and are connected with the application member via separate colour sections. The installation of a colour-changer valve arrangement in practice also referred to as ICC technology (Integrated Colour Changer) into the atomiser has the advantage of significantly reducing the paint and flushing agent losses during colour change. In case of painting car bodies, for example, the losses during colour changes from approx. 45 ml paint per atomiser and colour change with conventional colour change technology are reduced to only approx. 4 ml. A similar reduction is obtained for flushing agent losses. Moreover, the duration of colour change in typical cases can be reduced by half, from around 12 to 6 seconds, leading to a capacity increase of the coating facility of around 5-10% or for example 30-60 vehicles daily.

Due to the space required for the colour changer and the paint supply lines into the atomiser, the reduced number of selectable colours is disadvantageous in known systems with colour changers mounted into the atomiser. In place of supplying paint via one of the conventional colour changers, i.e, a modular colour change block with an outlet channel shared by the paints, the paints can also be supplied e. g. directly from circulation lines to the application member through respective paint lines each leading into the atomiser via colour valves located in the atomiser, for each of the paints being provided a separate metering device, which consequently is not to be flushed during a colour change and a greater number of less frequently required paints (so-called Low-Runners) being possible to connect via an external colour changer, as described in the German patent application 10 2006 022 570.8 of 15 May 2006 and in the patent application PCT/EP2007/003874 of 2 May 2007, the complete content of which is hereby included in the current description. The number of selectable frequently required paints (High-Runner), however, is also limited here by the available space in the atomiser, the lead through of paint lines via the wrist of the painting robot and by the space required for their assembly on the robot in upstream connection of metering devices.

Special colour supply systems offer the advantage of an unlimited number of applicable colours, in which the colours are not coming out of circulation lines, but produced in a paint mixing shop and lead to the atomiser via a colour changer. These systems, however, are relatively expensive and have considerable colour change losses in comparison to circulation line systems.

As was previously mentioned, in general, colour changers in paint shops are common, since, as is well known they allow swift changing from one paint to another during painting operation. However, they have the main disadvantage of unavoidable paint losses during flushing of the larger or smaller central channel with each colour change. After optimising the paint losses in pigged lines, metering devices etc., colour changers often represent the element of the coating facility with the most individual losses. The colour change loss is larger, the larger the diameter of the central channels is selected, to enable a larger quantity of paint to be channelled in a shorter time through the colour changer, which may be desirable for various reasons (special colour supplies, tank technology, higher paint quantities, shorter cycle times for consecutive workpieces, higher viscosities etc.). In addition, the colour change losses increase with the number of connected paints and the resultant length of the central channel, meaning that the number of colours must often be undesirably limited.

To avoid colour change losses in conventional colour changers, colour change systems operating based on the docking principle were developed, in which the paint lines provided for the various colours are connectable by mechanically movable valve elements to a line leading to the atomiser (EP 1 245 295 A2, DE 100 64 065 A1 or DE 601 11 607 T2). With these paint interfaces, paint savings (of typically 10 ml for each colour change) can be attained in comparison to conventional colour changers, however, they have various practical disadvantages such as complex motion control for starting up the connection positions, high maintenance requirement, flushing of the interface, paint drying out at the interface, leakages etc.

One proposed solution to the problem of reducing paint losses during a colour change is provided by the colour changer described in EP 1 502 657 A2, the central channel of which is sub-divided into flushable sections, the High-Runner paints often required, i.e. those with a high usage volume, being connected in the front section at the colour outlet, while at the rear, the less frequently required (Low-Runner) paints are connected in the section opposite to the colour outlet. While the often required front section can be continually flushed independently of the rear section, the less frequently required section can be flushed together with the other section. Since, as with conventional colour changers, during a colour change no longer the entire central channel is flushed, losses of paint and flushing agent are reduced. However, the persistent colour change losses are particularly undesirable for colours that are often required.

After the outlet from the colour changers, a paint pressure controller is usually located, which provides initial pressure control of a metering pump or, as was explained previously, which can act as the final control element for adjusting the paint quantity. The clearance volume of this paint pressure controller must be flushed with each colour change.

Based on the above-described state of technology, such as EP 1 502 658 A1 for example, one object of the present disclosure is to provide a coating apparatus or devices that can be used for the coating of workpieces particularly with different frequently required colours, which allow a colour change with minimal or low losses of paint, flushing agent and time.

DESCRIPTION OF THE DRAWINGS

Exemplary illustrations are explained with reference to the drawings. The figures show each in schematic and simplified form.

DETAILED DESCRIPTION

Figure 1:
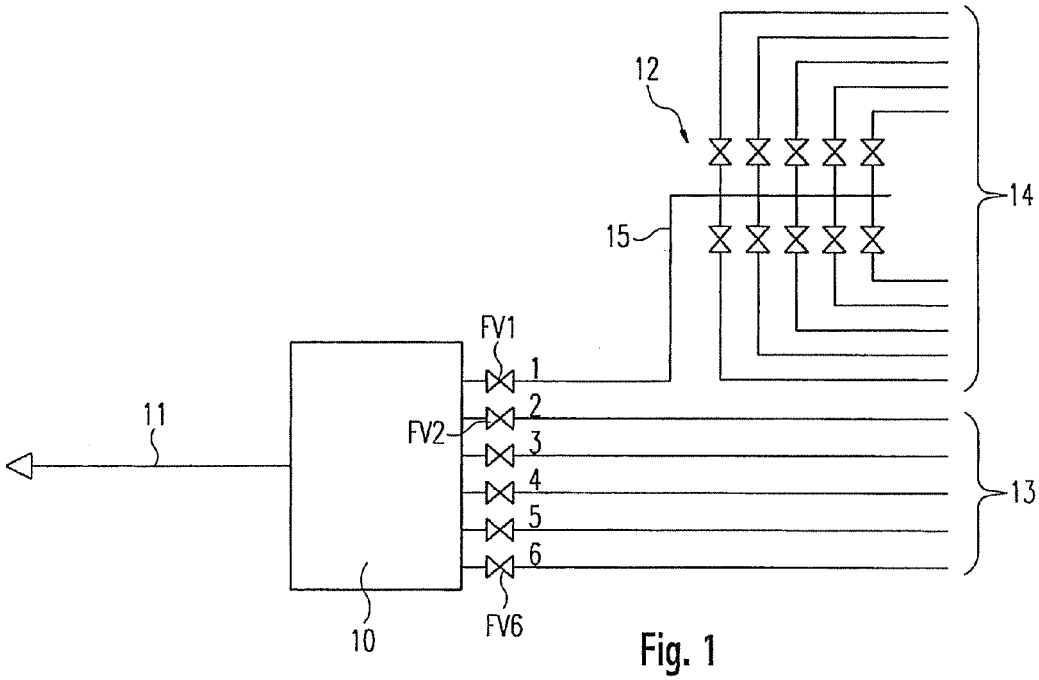
FIG. 1 a simplified conceptual drawing of a coating apparatus in accordance with an exemplary illustration.

In the automobile industry, approximately 70 or 80% of the production volume associated with a particular coating plant is generally limited to 7 colours or less. With the direct connection of these frequently required paints to the automatically controlled metering device, according to the exemplary illustrations herein, the colour change losses in terms of paint and flushing agent are reduced to a minimum due to the respectively frequent change of said High-Runner colours and likewise the required colour change times even beyond the previously described advantages of the ICC technology, without the overall number of selectable colours, including many rarely required or Low-Runner colours, for which colour change losses are less significant due to the less frequent colour changes, having to be limited. If a typical colour changer, with a shared central channel requiring flushing with each colour change, is not used for High-Runner colours, i.e. for the most frequently required colours or, equivalent, for the colours with the largest production volumes, the typical colour change losses resulting from the latter in terms of material and time are avoided. In addition, the colour change losses of a typical colour changer for less frequently required colours are also reduced, as its length is correspondingly shortened due to the omission of the most frequently required colours, unless in place thereof a respectively larger number of selectable colours is to be connected.

The colour change losses of the High-Runner colours are lowest, if both the metering device and the paint lines required for these paints are housed in the atomiser.

With direct connection of all paint lines to the metering device at each inlet, during a colour change, only the short path shared by the colours from the metering device to the application member, e.g., the bell cup of a rotary atomiser, need be flushed. Here, the associated paint valves controlled by external colour selection signals may advantageously be fitted to the metering device or mounted thereinto, however, the paint valves could also form, as shown in EP 1502658 A1, a colour changer situated upstream of the metering device with a central outlet channel shared by the paints.

It is also possible to arrange only the metering device into the atomiser itself, and, in contrast, to install the paint valves for the High-Runner colours only in the vicinity of the atomiser, for example between the atomiser and the wrist joint of the paint robot or another program-controlled automatic motion machine moving the atomiser. In this case, only one of the outlet lines from the paint valves for the colours runs into the metering device in the atomiser, and the paint valves can also form the typical colour changer. In addition, the scope of the exemplary illustrations also includes the possibility to mount both the metering device and the paint valves outside the atomiser, for example between the wrist joint and the atomiser, since also in this case, the colour change losses are still relatively low.

In other cases, conversely, it may be more convenient to arrange the metering device and/or the paint valves, where applicable in a conventional colour changer, also in the vicinity of the atomiser, but situated further away thereof, for example in or on an arm of a coating robot moving the atomiser or other program-controlled automatic motion machine. In particular, it may be convenient, in accordance with the mentioned EP 1 772 194 A2, to house a metering device comprising a plunger-type metering mechanism with an upstream paint storage vessel in the front arm of a painting robot.

In contrast, the colour changer provided for, where applicable, many but rarely required colours, is generally always arranged separate and further away from the atomiser, for example in or on an arm of the coating robot or similar. The losses when changing a colour are lower, the shorter the distance is between the colour changer and the atomiser, hence with a larger number of colours, due to the space requirement and for dynamic and other practical reasons, it can generally not be arranged in or on to the atomiser before the wrist joint of the painting robot or similar, as is often possible for the High-Runner paint valves, but at best in or on the front robot arm carrying the wrist joint, if not too many colours are connected. Within the scope of the exemplary illustrations, this colour changer could, however, be situated even further away from the atomiser, e.g., in the second robot arm, or to travel along with (on the so-called axle 7) or even outside the painting robot. Paint losses during a colour change as for example in this case, but also during the High-Runner colour supply described, may be avoided by additional measures such as pigging technology in connection with driving back of the paint remaining in the line up to the supply system ("Reflow") and/or almost complete use of the colours respectively remaining in the pipe for application ("Pushout").

The outlet of the separate colour changer for rarely required colours is connected, for example, parallel to the paint lines of the most frequently required High-Runner colours; to a separate additional inlet of the metering device or, where applicable, its storage vessel. In place of this arrangement, however, the outlet of this colour changer may also be connected directly to the atomiser, usually to its main needle valve, via a line running in parallel to the metering device for High-Runner colours and a separate metering device, which is either positioned within the atomiser or in largely optional distance outside of the atomiser.

In one example, situated in parallel to the separate colour changer for less frequently required colours, a further colour changer corresponding thereto is provided, which is connected to the paint lines for the same colours. This allows undesirable loss of time during colour changes to be avoided, since during the flushing of a colour changer and its outlet line and during the preparation for the next colour, (where applicable including Reflow) the atomiser can be supplied from the other respective colour changer. This alternating colour supply is usually referred to as A/B operation (c.f. e.g. EP 1314483 A). Both conforming supply branches (A and B) are connected in parallel to the atomiser, i.e. to two inlets of the metering device (where applicable, their storage vessel) or otherwise via a separate metering device to the main needle valve of the atomiser according to exemplary illustrations described herein. However, A/B operation is also possible for the High-Runner colour supply in accordance with the exemplary illustrations, with a further arrangement of a metering device and controlled paint valves corresponding to the arrangement of the metering device and the controlled paint valves for the frequently required colours being provided in parallel, with the paint valves of both units being connected to paint lines for the same colours, here as well. Instead, it is also possible to use a single plunger-type metering mechanism, but designed for alternating operation mainly in accordance with EP 1666158 A2, namely a motor-driven plunger-type metering mechanism with a cylinder, each of the areas of which separated by the plunger, has a plurality of controlled inlets for the various selectable colours and a controlled outlet connected with the main needle or other outlet valve of the atomiser.

For A/B operation, where each colour changer for paints generally requires less than, e.g., the 7 or fewer High-Runner colours, at least two line sections may conveniently be included, in each of which several controlled paint valves for coating materials with selectively changeable colours discharge, and from which at least one line section is flushable independent from at least one other line section, the line sections being connected to each other by a controlled lockable valve and/or with one outlet line of the colour changer. Such colour changers are generally provided by EP 1502657 A2, and for the purposes of reducing colour change losses, they allow a useful further differentiation between colours required differently frequently, the rarely required colours being connected to the line section of the colour changer further away from the colour outlet and the other colours to its other line section positioned at the paint outlet.

If two separated and parallel metering devices are included in the atomiser or in its vicinity, these metering devices can also be operated at the same time, to supply to the application member two components coming out of separate supply lines with a coating material such as 2K-lacquer.

In accordance with one particular aspect of the exemplary illustrations, which in some cases may be useful and advantageous even without the previously described feature of a colour changer for rarely required colours arranged distantly from the atomiser, the metering device mounted, for example, in the atomiser or in its vicinity has a plunger-type metering mechanism with an automatically controllable drive for the metering unit to adjust the piston speed during the application, for the construction of which a prior art can be used. The plunger-type metering mechanism in accordance with the exemplary illustrations or, where applicable, the storage vessel situated upstream of the same, however, unlike the known construction, does not have just one or if need be (as in the case of the mentioned EP 1666158) two inlets, but at least one separate inlet for each selectable and frequently required colour and at least one outlet shared by the supplyable colour materials. Besides the low material and time loss during colour changes, a plunger-type metering mechanism has specific advantages in comparison to gear metering pumps and other metering systems for example, such as improved flushablity with low flushing requirements as well as the possibility to push back the paint (Reflow) into the supply system e.g. such as circulation line directly via the paint valves, without the colour changers and the connecting section between the metering device and the colour changer having to be filled. A further significant advantage of the plunger-type metering mechanism is furthermore the fact that no paint pressure controller is required, somewhat in contrast to the presently available gear metering pumps, for which, mainly for reasons of metering precision, a separate paint pressure controller generally would have to be connected upstream for each connected colour line. The plunger-type metering mechanism avoids the disadvantages of pressure controllers such as costs, paint losses during colour change, space demand and weight-loading of the robot axles.

Among other things, to reduce colour change losses as well as for space and construction reasons, it is particularly convenient to mount the paint valves of the High-Runner paint lines controlled by colour selection signals to the metering device or to integrate them into the construction thereof. In the case of a plunger-type metering mechanism or a piston cylinder upstream thereof (which means a container with an optional, even non-circular profile ), at least the space available on one side of the piston cylinder can have multiple inlets for the paint lines for coating materials of different colours with the inlets having valves advantageously mounted into the cylinder or attached to the cylinder, which are controllable by signals for the selection of the coating materials supplied to the plunger-type metering mechanism. Such a plunger-type metering mechanism either with or without an upstream storage vessel, can also be useful and advantageous in itself and independently of the coating apparatus described here, also in any other paint supply systems, including systems in which the plunger-type metering mechanism is not situated in the atomiser or its vicinity. The same applies for the previously specified double-action plunger-type metering mechanism in accordance with EP 1666158 A2, where the inlets of one area of the cylinder provided for the various selectable colours can be situated in at or in the front end of the cylinder and the inlets of the other area can be situated at or in the opposing front end of the cylinder.

In accordance with another aspect of the exemplary illustrations, which can also be useful and advantageous in itself and regardless of the feature relating to the arrangement of the colour changer within or more or less far away from the atomiser, the colour selection valves can be mounted into a gear metering pump of conventional type or attached to the metering pump.

In accordance with a further aspect of the examples provided herein, which can also be useful and advantageous in itself and regardless of other of the described features, instead of the previously described examples, the paint valves can also be attached to or mounted into a container of a coating device, for example a coating robot, which is not used for metering, but in a normally known manner for other purposes, for example as intermediate or storage container.

The number of paint valves on or in a metering device or attached to or mounted into the housing of a coating apparatus for correspondingly many colour inlets depends on respective individual cases, but is generally more than two and may advantageously be more than four.

Turning now to FIG. 1, an exemplary coating apparatus includes a metering device 10, to the outlet 11 of which, the conventional main needle valve or similar of a (not shown) atomiser for colour material is connected, for example an electrostatic rotary atomiser or air atomiser. The outlet 11 is shared by a plurality, in the example shown, six colour inlets of the metering device 11, each of which having a colour valve FV1, FV2 etc. to FV6 automatically controlled by an superordinate control program. The metering device 10 per se can be of any kind, e.g., correspond to a metering system for coating facilities per se, including plunger-type metering mechanisms and gear metering pumps or systems operating with paint pressure and paint quantity adjustment. Volumetric metering devices and particularly those with a plunger-type metering mechanism, however, may be advantageous.

In the illustrated example, the paint lines 13 most frequently required for coating operations or "High-Runner" paints (marked 2 to 6) are connected to the paint valves FV2 to FV6 of the metering device 10, which is fed, for example, as a stub line from the conventional paint circulation lines in the coating facility or which also can be set up themselves as circulation lines. In contrast, one of the paint valves, here FV1, is connected via a paint line 15 to the outlet of an external colour changer 12 and used to separate the High-Runner colour change area from the Low-Runner colour changers 12. The colour changers 12 may have the conventional modular block format with a central channel as initially explained, to which, via the paint valves of the colour changer, the paint lines 14 for less frequently required or "Low-Runner" paints are connected. The exemplary illustrations of the colour changer 12 are described below with reference to FIG. 3.

As was previously explained, the metering device 10 and/or the paint valves FV1 to FV6 can primarily be positioned in the atomiser or movable with the same in its vicinity, particularly between the atomiser and the wrist joint of a painting robot or in the front arm thereof. As was also previously mentioned, the paint valves may be advantageously attached to the metering device 10 (plunger-type metering mechanism, storage vessel, metering pump or, where applicable, attached to the measuring cell or the paint pressure controller of metering systems normally known, etc.) or mounted within the same. The external colour changer 12, in contrast, can be situated in a place which, due to the colour change losses, should presumably be as close as possible to the atomiser, but apart from that is largely optional. For reasons of dynamic and space, a location on or in the rear robot arm may be practical, if an arrangement further to the front is not realisable.

When the metering device is constructed with a plunger-type metering mechanism or a volumetrically operating metering pump e.g. with an electrical drive motor, the metering drive may be situated outside the metering pump (for example as in EP 1000667 B). In particular, the metering drive may also be incorporated into the plunger-type metering mechanism or the metering pump.

The paint supply in accordance with the exemplary illustrations is suited for any atomisers, particularly also for electrostatic atomisers, which charge the coating material, as is well known, to a high voltage potential, for example in the range of 100 kV. In this case, sensors and actuators in the atomiser, including the metering device and its electrical metering drive, may be operating on the high voltage potential of the atomiser, as well as, where applicable, an electrical drive motor for the bell cup provided in place of the otherwise conventional air turbine, if a rotary atomiser is used. As is described in detail in the patent applications DE 10 2006 045 631.9 and PCT/EP2007/008382, the metering drive on high voltage and, where applicable, the electrical bell cup motor also on this voltage potential may be fed using an isolating transformer equipped with at least his secondary coil arrangement located in the atomiser. The isolating transformer forms a high voltage isolation section between its primary and secondary circuits and separates the items in the atomiser for which it supplies power, including both motors, galvanically from the electrical power supply leading into the atomiser.

As has already been described in the cited patent applications DE 10 2006 045 631.9 and PCT/EP2007/008382, the control and sensor signals of the actuators and sensors of the atomiser can be transmitted galvanically separated in and/or out of the atomiser, for example optically or via radio. In this case, particularly the external signals used to control the metering drive can be transmitted together with other signals via a common cable or radio link.

In accordance with a specific feature, which is also of benefit and feasible regardless of the High-Runner colour supply described herein, the operation of the conventional main needle valves or other outlet or main valves of the atomiser can be controlled via pressure generated by the metering device upstream of the main valve at the outlet (11). The main valve is opened by the pressure of the metering device, as soon and as long as a relevant pressure is there, and closes automatically in the absence of pressure. The functional principle corresponds to that of a conventional paint pressure controller in a coating facility, as known e.g. from the DÜRR/BEHR Technisches Handbuch, Einführung in die Technik der PKW-Lackierung, April/1999-28 Apr. 1999, chapter. 5.3.1 Farbdruckregler, or which is known from EP 1 376 289 B1, the complete content of which is incorporated herein by reference in its entirety. Such a paint pressure controller (which need not necessarily refer to a "controller" in the sense of a closed loop regulator circuit) may, in accordance with the exemplary illustrations, mainly replace the piston drive of the normal main needle valve and the external control of the same, whereby the valve is not opened by control air, but the paint pressure itself. Accordingly, the main valve of the atomiser or another application device consisting of a needle valve or of a ball or other valve for the coating material, which is kept in the closed position by spring pressure and opened by way of the pressure of the coating material acting against the spring pressure, e.g., via a membrane, as soon as this pressure reaches a defined value, which can be fixedly or also variably adjusted. In the present example, the control inlet of the main valve is connected to the outlet of the described metering device. This (indirect) automation of the main needle control by the metering device, advantageously eliminates the very complex adjustment of the main needle switch circuit of conventional atomisers, the main needle valve of which may only be opened and closed by external signals of the program control of the coating facility (c.f. e.g. EP 1245291 B1).

Figure 2:
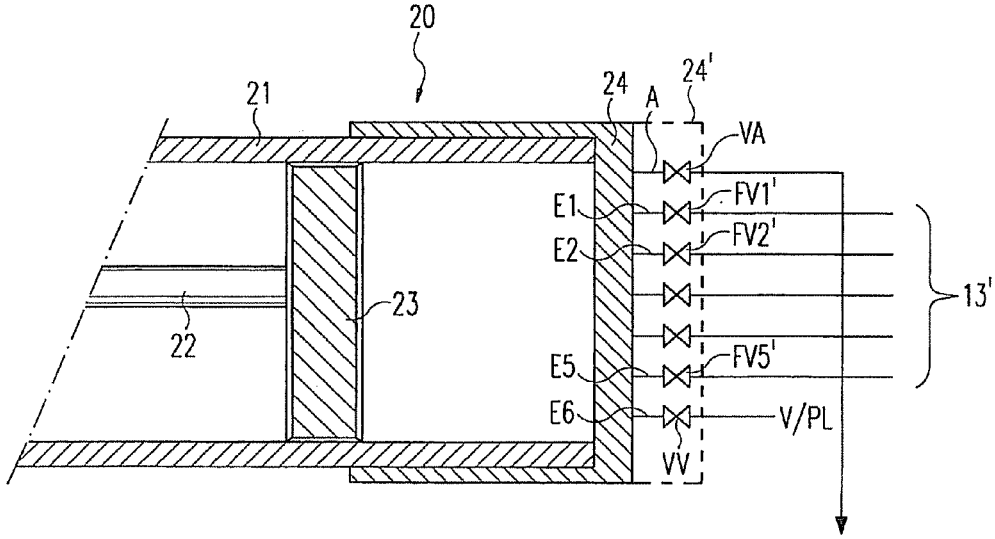
FIG. 2 a plunger-type metering mechanism in accordance with an exemplary illustration.

In FIG. 2, a plunger-type metering mechanism 20 is illustrated schematically, which generally includes a cylinder 21, a piston 23 slidable in the cylinder by the piston rod 22 as well as a metering drive (not shown). The components of the plunger-type metering mechanism 20 may, due to the high voltages involved, consist of insulating material and of a ceramic material to improve the metering precision. The metering drive may usually incorporate an electrical motor used to move the piston rod, which is controlled such that by altering the piston speed during the coating process, the current quantity of coating material applied can be altered as required. Plunger-type metering mechanisms operating on the same principle are provided, for example, in EP 1384885 B and WO 93/23173.

In accordance with the exemplary illustrations, however, the plunger-type metering mechanism 20 has multiple inlets: five colour inlets in the illustrated example E1 to E5, each of which has a paint valve FV1' to FV5', each of which is connected to one of the five paint lines 13' for different High-Runner colours. An additional inlet E6, also equipped with a valve VV, is intended for discharging a thinner V used as flushing agent and also pulse air PL intended for cleaning of cylinder 21. In addition, cylinder 21 has an outlet A with an outlet valve VA, to which an outlet line of the plunger-type metering mechanism leading to the main needle or outlet valve of the atomiser is connected.

The paint valves FV may be attached to the cylinder body 24 of the plunger-type metering mechanism or incorporated in the same, as indicated by the dotted line 24'. The flushing valve VV and/or the outlet valve FA can be attached or mounted, correspondingly.

If the plunger-type metering mechanism 20 of the example described in FIG. 2 as metering device 10 on the basis of the device described of FIG. 1 is used, one of the colour inlets, such as E1 to E5, of the plunger-type metering mechanisms may also (instead of to a High-Runner paint line) be connected to a paint line coming from an external colour changer, e.g. the paint line coming from the colour changer 12 in FIG. 1 for rarely required colours. Instead, however, here as well, the outlet line of an external colour changer can be routed to the outlet valve of the atomiser by bypassing the plunger-type metering mechanisms 20.

In the scope of the exemplary illustrations, the element 20 in FIG. 2, also may be a paint storage container located upstream of the actual plunger-type metering mechanism, for example, in accordance with EP 1 772 194 A2, the piston of which, however, is usually not driven by an electrical motor, but by the coating material in the filling direction and a pressure medium such as compressed air, in the discharging direction.

A further development of the plunger-type metering mechanism 20 for alternating operation of the cylinder areas separated by the piston 23 in accordance with EP 1666158 A2, could provide an arrangement corresponding to the inlets E1 to E6 and the outlet A with the associated valves, for example, in the cylinder body of the plunger-type metering mechanism opposite to the cylinder body 24.

Figure 3:
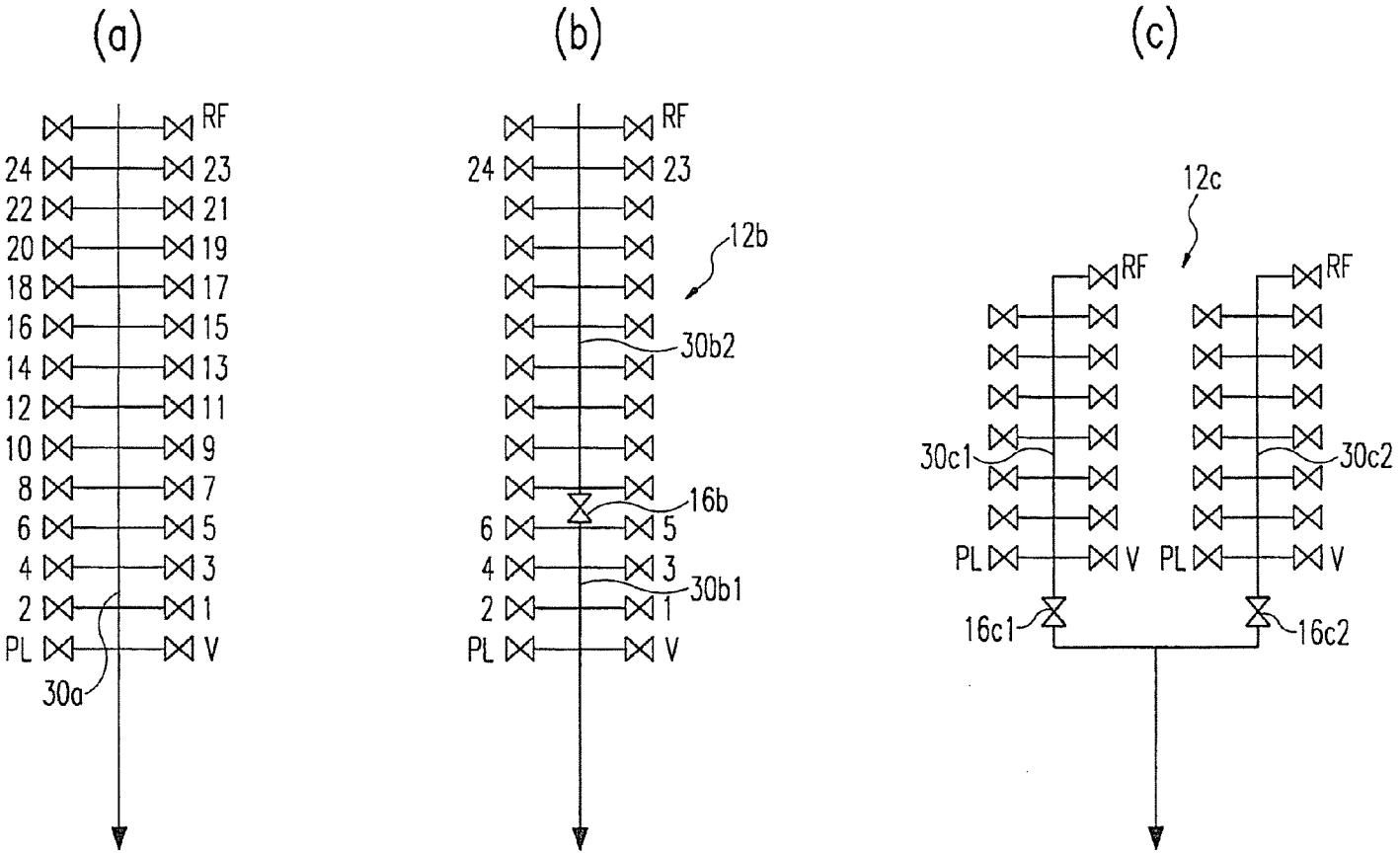
FIG. 3 (a), (b), (c) to three different colour changers, which can be used in a coating apparatus in accordance with an exemplary illustration.

The external colour changers 12 (FIG. 1) provided for the exemplary illustrations for rarely required colours could have the structure which is schematically illustrated in FIG. 3(*a*), such as, for example, generally provided by DE 19836604 A1, DE 19846073 A1 or DE 19951956 A1. It therefore consists mainly of paint valves for the twenty-four different colours used for the described example, flushing valves for pulse air PL and thinner V and a return valve RF, which are connected to the central channel 30*a* of the colour changer.

Since the colours connected to the external colour changer are those which differ per se in the frequency of use, it may indeed be more practical to divide the external colour changer in the known example of EP 1502657 A2 into separated flushable channel sections. The schematically illustrated colour changer 12*b* in FIG. 3(*b*) corresponds substantially to the exemplary illustration in accordance with FIG. 2 of the cited EP 1502657 A2, the complete content of which is hereby incorporated by reference in its entirety. Both channel sections are designated 30*b*1 and 30*b*2 respectively and connected by the controlled lockable valve 16*b* in series with each other. The more frequently required colours are connected with the paint valves designated 1 to 6 of section 30*b*1, while in contrast, the rarely required colours are connected to the normal paint valves of section 30*b*2. This leads, in practice, to reduced colour change losses compared to standard colour changers in accordance with FIG. 3(*a*).

Figure 4:
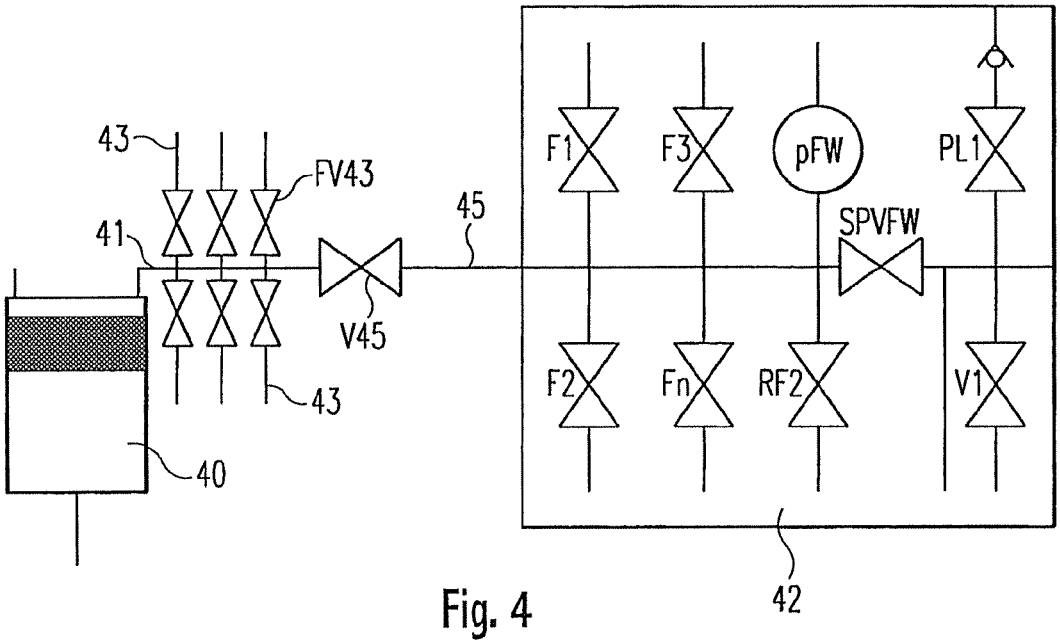
FIG. 4 a modified exemplary illustration with respect to FIG. 2.

The colour changer 12*c* illustrated in FIG. 3(*c*), which may largely correspond to the example in accordance with FIG. 3 or FIG. 4 of EP 1502657 A2, consists of both parallel channel sections 30*c*1 and 30*c*2, which are alongside the respective paint, rinse and return valves and respectively connected via a controlled lockable valve 16*c*1 or 16*c*2 to the output line of the colour changer. This colour changer, in addition to reduced colour change losses, has other benefits such as the relatively low space requirement and low weight or a large number of connectable paints at a given size.

If the same colours are connected to both channel sections 30*c*1 and 30*c*2, the colour changers are also suited for A/B operation. Thus, an always shortened colour change period for all selectable colours is reached.

Figure 7:
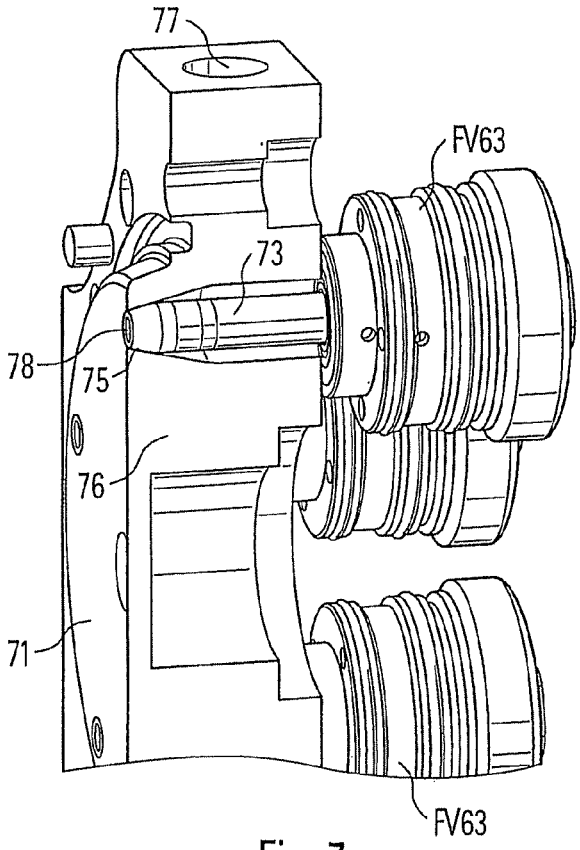
FIG. 7 a radial cut through the end wall of the device in accordance with FIG. 6.
Figure 8:
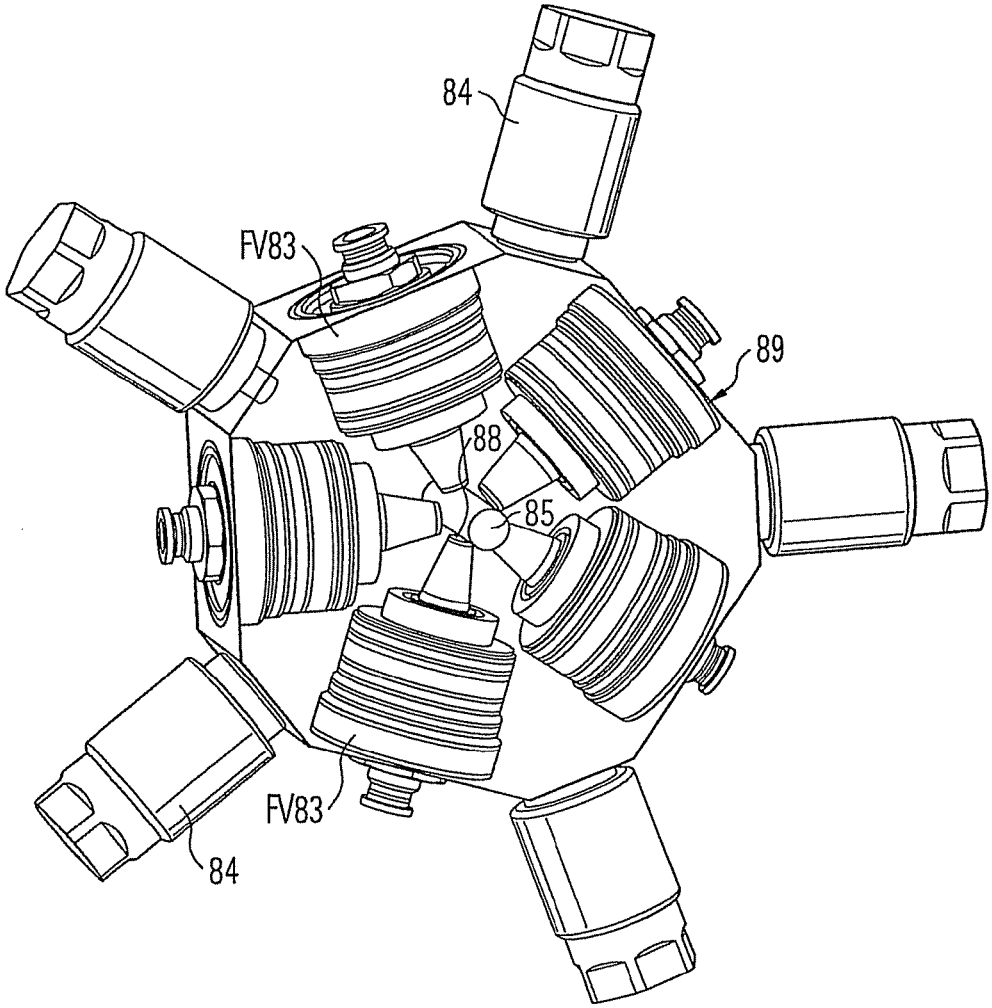
FIG. 8 a practical constructional implementation of the metering device in accordance with FIG. 4.

In the exemplary illustration in accordance with FIG. 2, the paint valves for the High-Runner colours can be positioned almost flush, i.e. free of colour losses, with the inner wall of the cylinder of the plunger-type metering mechanism or, where applicable, its interim storage container (c.f. FIG. 7). FIG. 4, in contrast, shows a schematic and somewhat modified exemplary illustration, in which the paint valves FV43 connected to the High-Runner lines 43 discharge into a shared channel 41, which, in turn, leads into the cylinder of the plunger-type metering mechanism or, where applicable, its interim storage container 40. The paint line 45 from the outlet of the external colour changer 42 for the Low-Runner paints is connected to the shared channel 41 via an isolating valve V45 separating the two colour supply systems for High-Runner or Low-Runner paints. Structurally, the paint line 45 can be an integral component of the conventional central channel of the colour changer 42 and turn into channel 41 or form it (c.f. FIG. 8). The colour changer 42 can, for example, include the arrangement to be extracted from the drawings of the paint valves F1 to Fn for the n different available Low-Runner colours, the return valve RF2, the flushing valves V1 and PL1 for thinner or pulse air as well as, in accordance with the illustration, the isolating valve SPVFW between the paint and return valves on one side and the purge valves on the other. The Low-Runner colour changer may also correspond to one of the arrangements in accordance with FIG. 3. pFW is a paint pressure sensor measuring the pressure of the coating material in the central channel of the colour charger shared by the different Low-Runner colours and thus in the paint line 45 to improve process security. The paint lossy central channel of the colour changer 42 simply need be filled with this colour during painting with Low-Runner paint. When painting with a High-Runner colour, the colour changer 42 is separated with isolating valve V45.

Figure 5:
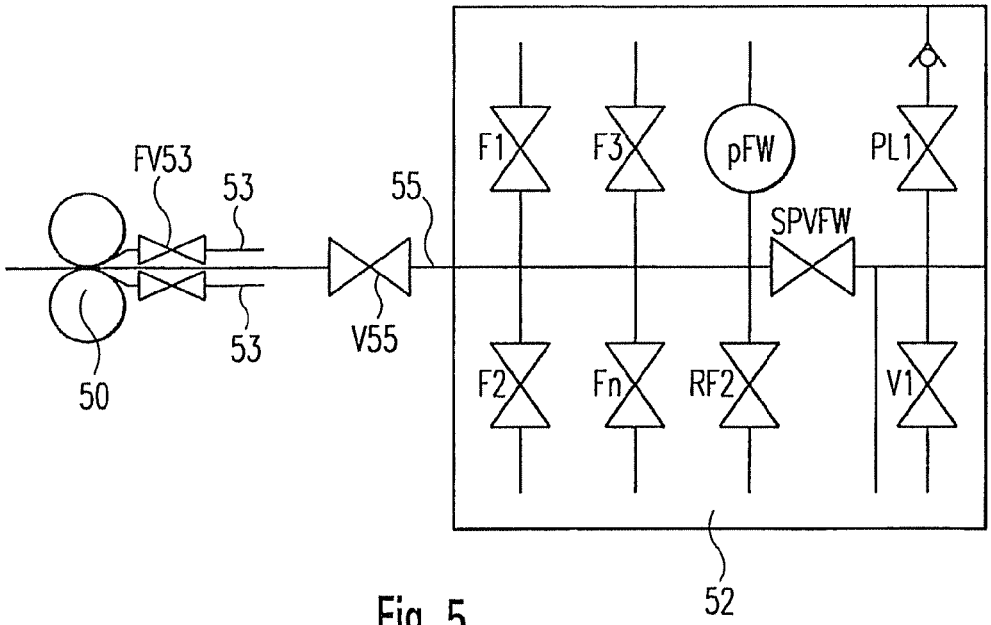
FIG. 5 an exemplary illustration with a gear metering pump.

In FIG. 5, another example is schematically illustrated, in which the metering device is formed by a gear metering pump 50, which differs from conventional metering pumps due to its multiple inlets, to which paint lines 53 for the High-Runner colours via paint valve FV53 and in parallel, paint line 55 from the outlet of the other colour changer 52 for the Low-Runner paints are connected. The paint valves FV53, with which the inlets for the High-Runner colours are provided, can advantageously be positioned also directly almost without colour losses at the metering gear wheels of the metering pump 50. Here, as with the other exemplary illustrations, the paint valves can be configured as needle valves in the conventional manner. The isolating valve V55 for the Low-Runner paints can be mounted into the inlet of the metering pump 50 or upstream thereof. The colour changer 52 can correspond to that in accordance with FIG. 4 or also to one of the colour changers in accordance with FIG. 3. The Low-Runner colour changers in accordance with FIG. 4 and FIG. 5 can also be used for the exemplary illustrations in accordance with FIG. 1 and FIG. 2.

Figure 6:
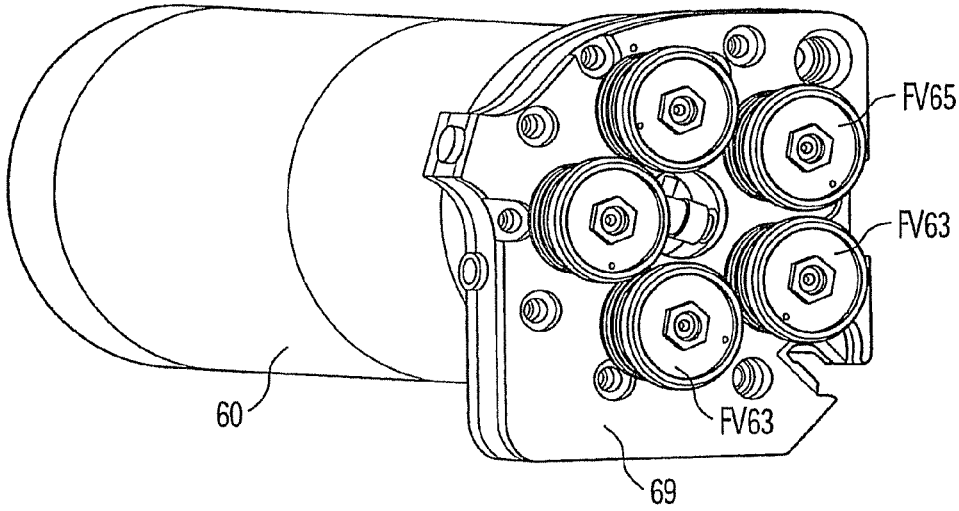
FIG. 6 a practical constructional implementation of the metering device in accordance with FIG. 2.

In FIG. 6, an elongate paint container 60 is illustrated, which can be, for example, the storage container for the metering devices mentioned several times and known or can instead also be a plunger-type metering mechanism in accordance with FIG. 2. The, for example, four or five High-Runner valves FV63 shown in accordance with the illustration, are arranged parallel to the container axis next to each other in the end wall 69 of the container 60, possible in addition to a further valve VF65 for the Low-Runner colours. The associated paint lines controlled by these valves can be conveniently connected by radial paint connections distributed along the circumference of the container (not shown). The isolating valve for the Low-Runner line (not shown) (V45 in FIG. 4) can also be configured differently than the valve FV63 and arranged elsewhere. The container 60 may be at least partially circular cylindrical or with another diameter and housing a movable piston.

As shown in FIG. 7, the needles 73 of the High-Runner paint valves FV 63, which can be the signal-controlled needle valve units of the illustrated conventional model per se, are inserted in the end wall 76 (69 in FIG. 6), such that when the valve closes, the needle ends 78 are at least near the level of the inner side 71 of the end wall 76, i.e. aligned with this level. In 75, the conical valve seat of paint valve FV63 is visible. In opening 77, for example, one of the paint connections leading radially from the circumference into the end wall 76 can be used for the High-Runner-paint lines (13 in FIG. 1) opened or closed by the paint valves FW63.

In place of the illustrated valve arrangement in FIG. 6 and FIG. 7 a radial installation or attachment of the paint valves FV63 (valve FV in FIG. 1 or FIG. 2) is possible, for example similar to one of the examples in accordance with FIG. 8 to 14.

As a rule, the High-Runner paint valves for the exemplary illustrations described generally should be as small as possible, so that as many valves as possible can be accommodated within the limited available space. The same applies for an installed or attached valve for the connection of Low-Runner paints (e.g. valve FV1 in FIG. 1). The paint valves of the distant or separate Low-Runner colour changer, in contrast, can be constructed larger. The larger installation size has the advantage that at a given paint pressure, the flow openings can be larger and the paint flow speed correspondingly smaller, thus lowering the risk of damage to the paint materials.

The valve arrangement illustrated in FIG. 8 suits an exemplary illustration in accordance with FIG. 4, in which the illustrated five High-Runner paint valves FV83 are distributed radially around the central channel 85 of the Low-Runner colour changer (42 in FIG. 4) and reach the circumference of the central channel 85 with the ends 88 of their valve needles. The paint valves FV83 can here be screwed into the circumference of a wall element 89 in a radial level shared by their needle axes which can form the end wall of the container mentioned or be attached to the actual end wall. Between the paint valves FV83, in accordance with the illustration, the related paint connections 84 for the High-Runner colours are distributed over the circumference of the wall element 89. In place of the illustrated star-shaped valve arrangement, for example, other known arrangements of colour changers are also conceivable.

Figure 9:
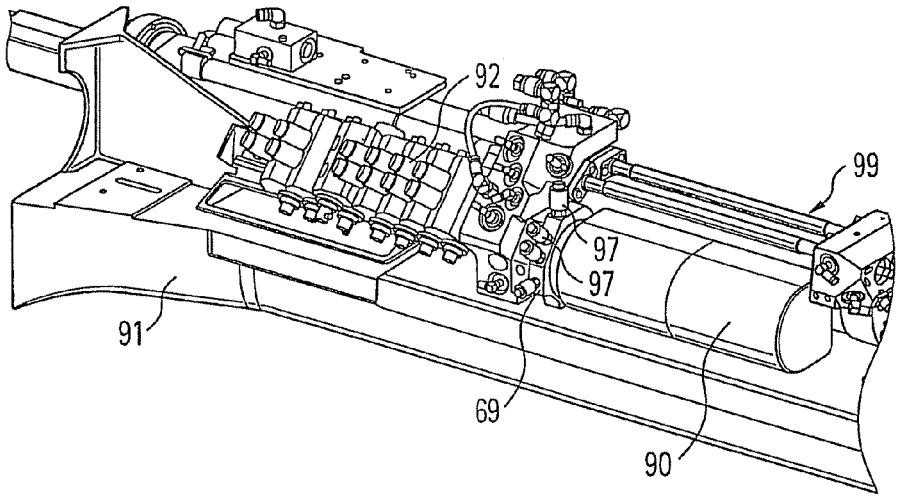
FIG. 9 the arrangement of a metering device for example with a container in accordance with FIG. 6 in the front arm of a painting robot.

FIG. 9 shows a convenient arrangement of a container 90 with the accompanying end wall 69 or 76 containing the High-Runner valves and associated radial paint connections 97, for example in accordance with FIG. 7, and with the upstream Low-Runner colour changer 92 in the front arm 91 of a painting robot. The colour changer 92 hat as a typically modular block construction for the colour changers in the coating facility and is constructed in direct vicinity to the end wall 69. A very similar arrangement is also possible with the examples in accordance with FIG. 8. The arrangement of the container 90 next to a (only partially visible) plunger-type metering mechanism 99 and other details are to be seen in the drawing and can apart from that correspond to the system described in EP 1 772 194 A2, so that a more precise description is not needed.

Figure 10:
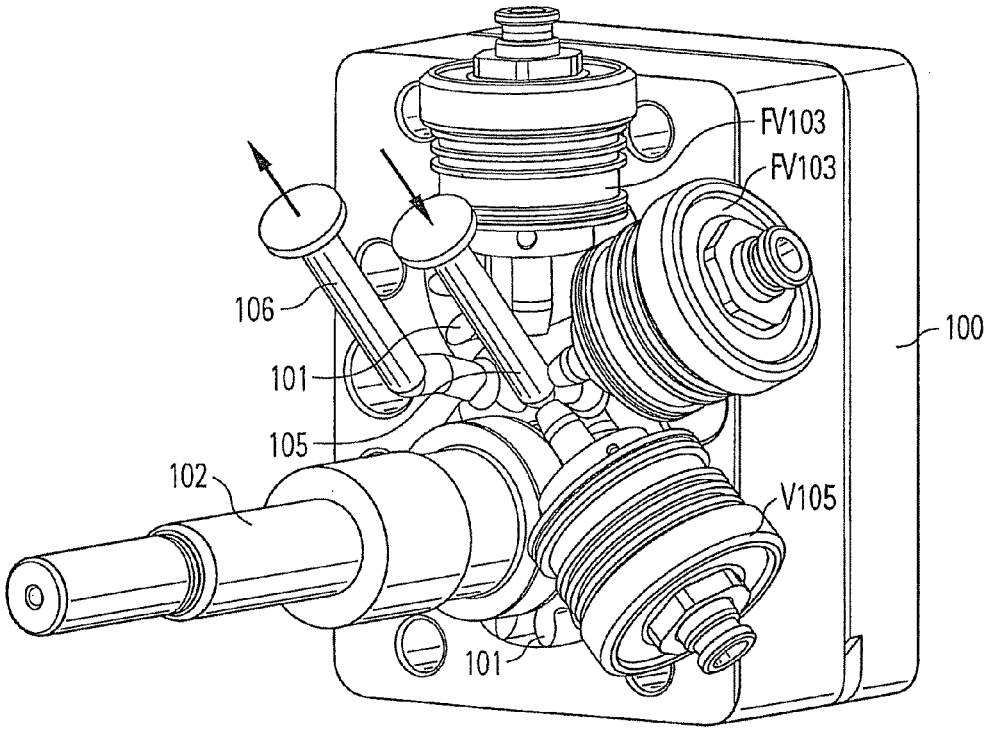
FIG. 10 a practical constructional implementation of the metering device and its valves in accordance with FIG. 5.

FIG. 10 shows the possibility for the constructional configuration of the High-Runner paint valves FW103 at paint inlet 105 of a gear-metering pump 100 corresponding to the schematic illustration in FIG. 5. Both metering gear wheels 101 and their driveshaft 102 correspond to conventional constructions. The inlet area in accordance with the metering pump, however, is not shown completely. Similar needle valve units as installed in the other exemplary illustrations, can be installed as paint valves, for example, radially in the front plate unit of the metering pump 100 not shown, in accordance with the illustration. Also the High-Runner paint pipes controlled by the paint valves FW103 are not shown. The paint inlet 105 can be connected to the separate Low-Runner colour changer in accordance with the exemplary illustrations via an isolating valve V55 (FIG. 5), which can be formed by valve V105 or arranged elsewhere. The paint outlet for the metering pump 100 is referenced as 106.

Figure 11:
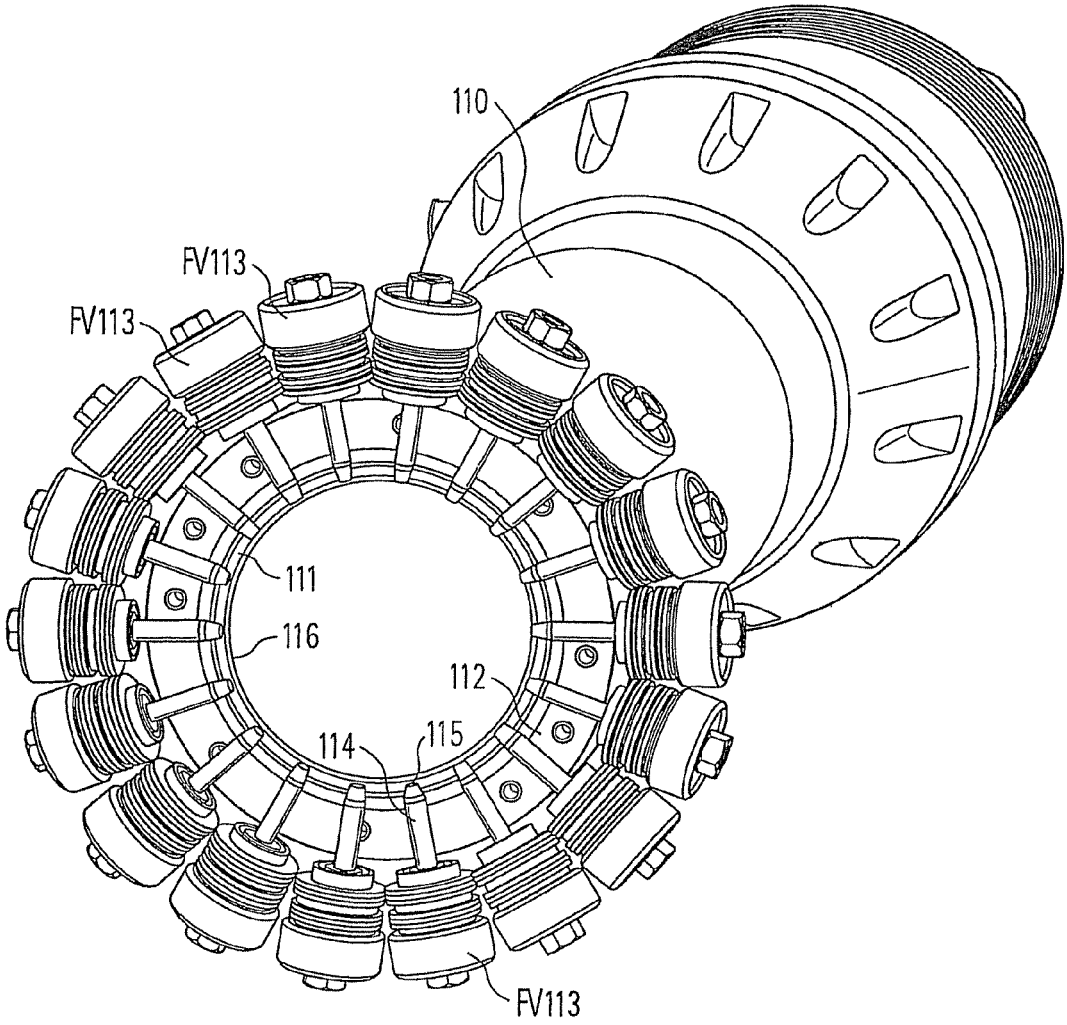
FIG. 11 the installation of paint valves within the area of the optionally available housing of a coating apparatus.

As was previously explained, the installation or attachment of paint valves described above in the context with metering devices can independent thereof more generally be useful and advantageous for any other container for coating apparatus. In FIG. 11, such a container 110 is illustrated, which may be cylindrical or have another, for example, elongate shape in accordance with the illustration. The illustrated example 18 shows automatically signal-controlled needle valves FV113 distributed around the circumference of the container 110, the valve needles 114 thereof may lie crosswise with respect to the longitudinal axis of the container 110 in a shared radial level. For example, the needle valves FV113, in accordance with the illustration, may be inserted radially in a flange 112 surrounding the cylindrical wall 111 of the container 110 and extend through the latter with its needles 114. In a closed position of the valves, the ends 115 of the needles contacting the valve seat can be positioned flush or almost flush against the inner surface 116 of the container wall 111, so that similarly low colour change losses occur, such as, for example, in the examples in accordance with FIG. 7, FIG. 8 and FIG. 10. The paint lines controlled by the paint valves FV113 leading into the containers 110 are not shown.

In this exemplary illustration, no separate colour changer in accordance with FIG. 1 to FIG. 5 is needed to be provided, nor any central channel of a colour changer as shown in 58 in FIG. 8, particularly when the number of colours required does not exceed the existing number of paint valves 113. On demand, however, the connection of a conventional colour changer for additionally selectable colours is possible, for example to one of the paint valves FV113 or another automatically controllable inlet of the container 110.

Coating systems are also conceivable, in which, for example, the colour inlets of the container 110, mounted for example on a coating robot in a manner known per se can be docked with quick release valves at corresponding stationary paint connections of a paint booth.

Figure 12:
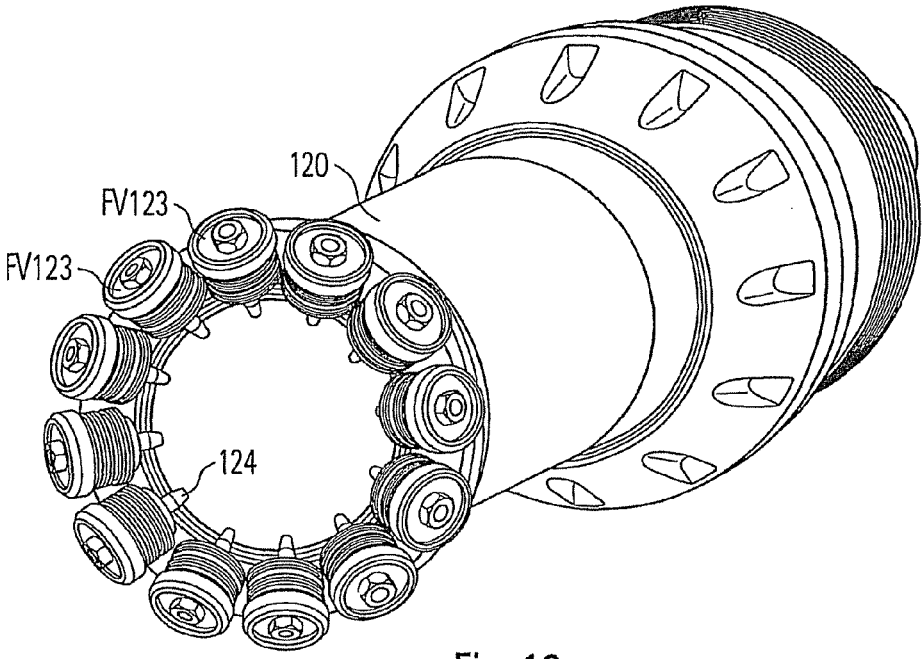
FIG. 12 a modification to the exemplary illustration in accordance with FIG. 11.
Figure 13:
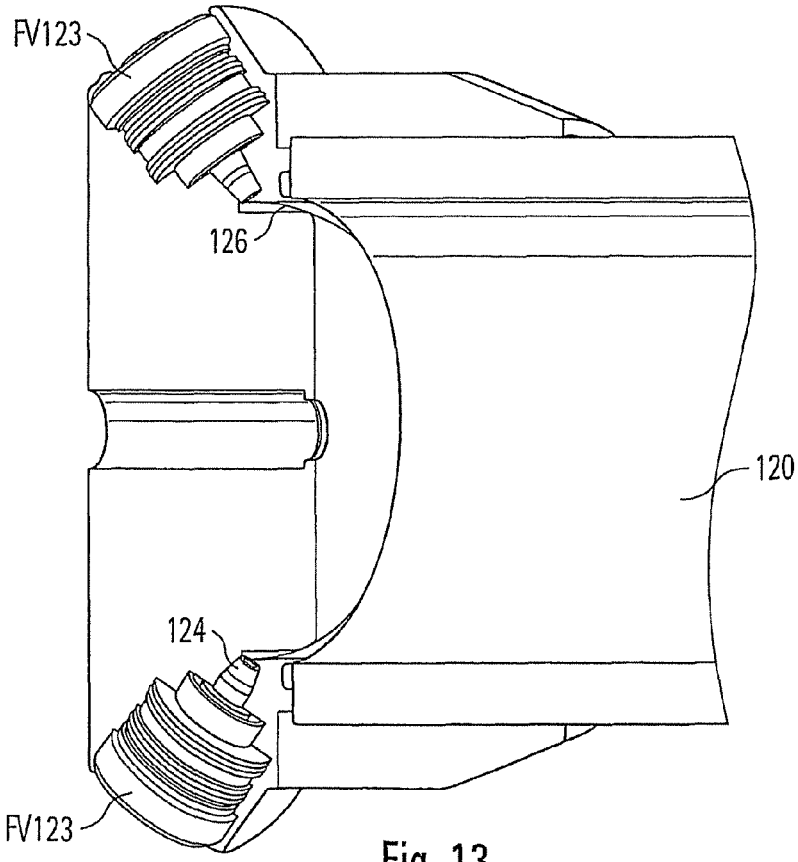
FIG. 13 a schematic sectional view of the exemplary illustration in accordance with FIG. 12.

The only substantial difference between the exemplary illustration in accordance with FIG. 12 and that in accordance with FIG. 11 is that the needles 124 of the 12 paint valves FV 123 in the illustrated example are not positioned in one radial plane, but arranged against the vertical radial level of the container axis at an angle, resulting in the angular arrangement of valve FV123 visible in FIG. 13. Here as well, in a closed position of the valve, the valve seat and thus the needle ends, is located in direct vicinity of the inner surface 126 of the container 120 with the advantage of correspondingly minimised paint losses in a colour change.

Figure 14:
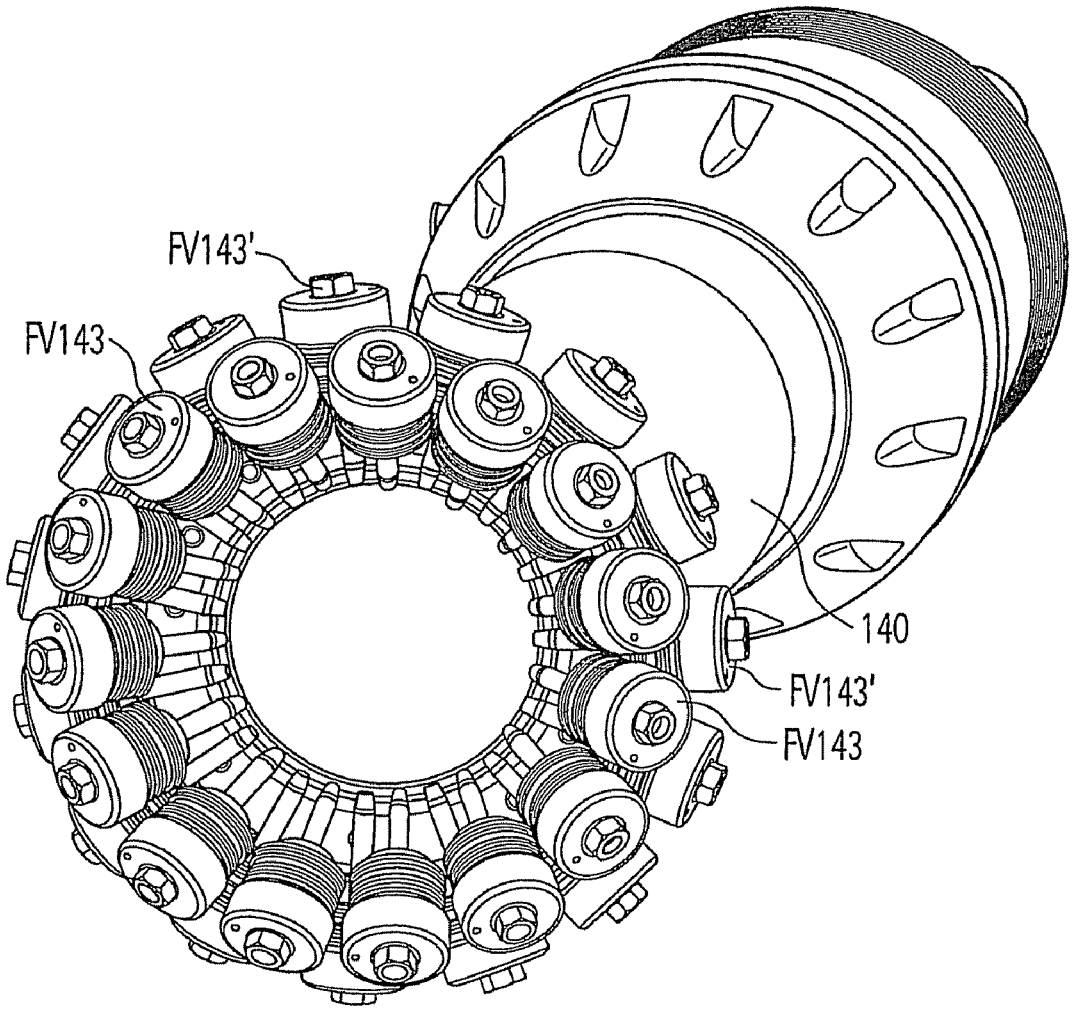
FIG. 14 a further modification of the exemplary illustrations in accordance with FIGS. 11 and 12.

If two or more groups of paint valves distributed in a ringlike manner around the container circumference are offset or spaced apart along the container axis, as shown in FIG. 14, a correspondingly large number—in the illustrated example 30—of valve-controlled paint lines for various selectable colours can be connected to the container 140. Both illustrated groups of paint valves FV143 or FV143' can be positioned at an angle as shown in FIG. 12 and FIG. 13, conveniently at an opposing tilt angle related to the radial level. One or each group of paint valves, however, can also be arranged horizontally on a common radial level to the container axis as shown in FIG. 11. Apart from that, the exemplary illustration in accordance with FIG. 14 may correspond to those in accordance with FIG. 12 and FIG. 13.

For the automatic control of the paint valves of the described exemplary illustrations, for example electric or pneumatic signal lines, which are not shown in the drawings, can be connected to the valves in any known manner that is convenient.

Generally, the combination of each of the various features described in the present application with one or more other described feature/s without being limited to other features is possible and advantageous depending on the manner of realisation.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

The invention claimed is:

1. A coating apparatus for the serial coating of workpieces where the work pieces are coated with different colors, the different colors including high runner colors and low runner colors, the apparatus comprising:

an atomiser configured to apply a coating material onto the workpiece;

a metering device operable in delivering coating material to the atomiser;

a plurality of first paint lines, each line including a controlled valve, the first paint lines being directly connected to the metering device; where the first paint lines include high runner colors;

a plurality of second paint lines, each line being connected to a color changer, where the second paint lines include low runner colors; the color changer including an outlet line with the outlet line being directly connected to the metering device.

2. A coating apparatus, as in claim 1 wherein the metering device is a plunger-type metering mechanism including a driving motor controllable to change its speed.

3. The coating apparatus in accordance with claim 1, wherein the metering device includes a gear metering pump.

4. The coating apparatus in accordance with claim 1, wherein the metering device is arranged in the atomiser so as to be movable therewith.

5. The coating apparatus in accordance with one of the claim 1, wherein the metering device is arranged between the atomiser and a wrist joint of a coating robot.

6. The coating apparatus in accordance with claim 1, wherein the colour changer is arranged with an arm of a coating robot.

7. The coating apparatus in accordance with claim 1, wherein at least one line of the plurality of second paint lines section is independently flushable.

8. The coating apparatus in accordance with claim 1, wherein the controlled valves of the first paint lines are attached the metering device.

9. The coating apparatus in accordance with claim 1, wherein an electrical drive motor of the metering device is arranged with the atomiser.

10. The coating apparatus in accordance with claim 1 with an electrostatic atomiser, wherein the metering device is on a high voltage potential, the metering device being fed potential-separatedly by an isolating transformer provided in the atomiser, which transformer contains a high voltage insulation section.

11. The coating apparatus in accordance with claim 1, wherein, two separated parallel metering devices are provided.

12. A coating apparatus in accordance with claim 1, including an A/B operation.

13. The coating apparatus in accordance with claim 1, wherein the metering device is a motor-driven plunger-type metering mechanism with a cylinder, whose areas separated by a piston and have each a plurality of controlled inlets and a plurality of controlled outlets connected to the outlet valve of the atomiser.

14. The coating apparatus in accordance with claim 13, wherein the inlets of one of the areas are located in one end of the cylinder.

15. A coating apparatus according to claim 1, wherein the metering device is provided within the atomiser upstream of an application member.

* * * * *